US011255593B2

(12) United States Patent
Junge et al.

(10) Patent No.: US 11,255,593 B2
(45) Date of Patent: Feb. 22, 2022

(54) ICE MAKING ASSEMBLY INCLUDING A SEALED SYSTEM FOR REGULATING THE TEMPERATURE OF THE ICE MOLD

(71) Applicant: Haier US Appliance Solutions, Inc., Wilmington, DE (US)

(72) Inventors: Brent Alden Junge, Evansville, IN (US); Justin Tyler Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 104 days.

(21) Appl. No.: 16/445,489

(22) Filed: Jun. 19, 2019

(65) Prior Publication Data

US 2020/0400363 A1 Dec. 24, 2020

(51) Int. Cl.
*F25D 17/02* (2006.01)
*F25C 1/04* (2018.01)

(52) U.S. Cl.
CPC ..... *F25D 17/02* (2013.01); *F25C 1/04* (2013.01); *F25C 2301/00* (2013.01); *F25C 2700/12* (2013.01)

(58) Field of Classification Search
CPC ..... F25B 2400/0403; F25B 2400/0411; F25B 2600/2501; F25C 1/04; F25C 2700/12; F25C 2301/00; F25C 1/045; F25C 2600/04; F25C 5/10; F25D 17/02
See application file for complete search history.

(56) References Cited

U.S. PATENT DOCUMENTS 1,781,541 A * 11/1930 Einstein ..... F25B 15/10 62/110
1,996,050 A * 3/1935 Pownall ..... F25C 1/22 62/68
2,583,294 A * 1/1952 Erickson ..... F25C 1/045 62/137
2,586,588 A * 2/1952 Weseman ..... F25C 1/04 62/348
2,691,275 A * 10/1954 Andrews ..... F25C 1/12 62/74
2,743,588 A * 5/1956 Dreier ..... F25C 1/04 62/142
2,775,099 A * 12/1956 Brown ..... F25C 5/08 62/351
2,791,103 A * 5/1957 Guild ..... F25C 1/12 62/137

(Continued)

FOREIGN PATENT DOCUMENTS

JP 2003262442 A 9/2003
JP 2015190707 A 11/2015

(Continued)

*Primary Examiner* — Ljiljana V. Ciric
(74) *Attorney, Agent, or Firm* — Dority & Manning, P.A.

(57) ABSTRACT

An ice making assembly includes an ice mold defining a mold cavity and a refrigeration loop having an evaporator in thermal communication with the ice mold. A compressor is operably coupled to the refrigeration loop for circulating a flow of refrigerant through the refrigerant loop to cool the evaporator and the ice mold. After ice is formed, a flow regulating device may divert a portion of the flow of refrigerant around the condenser through a bypass conduit to slowly increase a temperature of the refrigerant within the evaporator.

18 Claims, 5 Drawing Sheets

(56) References Cited

U.S. PATENT DOCUMENTS 2,941,377 A * 6/1960 Nelson ..... F25C 1/04 62/73
2,983,109 A * 5/1961 Leeson ..... F25C 1/12 62/73
3,009,336 A * 11/1961 Bayston ..... F25C 1/045 62/344
3,054,274 A * 9/1962 Mcgehee ..... F25C 1/12 62/138
3,130,556 A * 4/1964 Goldsborough ..... F25C 1/04 62/73
3,217,509 A * 11/1965 Weil ..... F25C 5/20 62/320
3,277,661 A * 10/1966 Dwyer ..... F25C 1/045 62/135
3,298,189 A * 1/1967 Beck ..... F25C 1/04 62/135
3,430,452 A * 3/1969 Dedricks ..... F25C 1/12 62/138
3,459,005 A * 8/1969 Sorensen ..... F25C 1/12 62/138
3,653,221 A * 4/1972 Angus ..... F25D 17/02 62/59
3,759,048 A * 9/1973 Cochran ..... F25C 5/10 62/73
3,826,102 A * 7/1974 Horvay ..... F25C 1/04 62/137
3,964,270 A * 6/1976 Dwyer ..... F25C 1/045 62/138
4,009,594 A * 3/1977 Swanson ..... F25C 1/12 62/278
4,099,946 A * 7/1978 Alexander ..... F25C 1/06 62/73
4,137,724 A * 2/1979 Alexander ..... F25C 5/10 62/138
4,276,751 A * 7/1981 Saltzman ..... F25C 1/12 62/138
4,324,109 A * 4/1982 Garland ..... F25C 5/10 62/353
4,375,756 A * 3/1983 Lanzani ..... F25C 1/045 239/469
4,404,810 A * 9/1983 Garland ..... F25C 5/10 62/220
4,510,761 A * 4/1985 Quarles ..... F25C 5/10 417/118
4,688,386 A * 8/1987 Lane ..... F25C 1/12 62/348
4,694,656 A * 9/1987 Lane ..... F25C 1/12 62/347
4,791,792 A * 12/1988 Naruse ..... F25C 5/10 62/135
4,899,552 A * 2/1990 Minari ..... F25B 41/20 62/352
4,907,422 A * 3/1990 Kohl ..... F25B 47/022 62/278
4,910,974 A * 3/1990 Hara ..... F25C 1/045 62/347
4,924,678 A * 5/1990 Ito ..... F25C 1/045 62/138
4,932,216 A * 6/1990 Ito ..... F25C 1/045 62/129
4,970,877 A 11/1990 Dimijian
4,982,574 A * 1/1991 Morris, Jr. ..... F25C 5/10 62/155
4,986,083 A * 1/1991 Naruse ..... F25B 47/022 62/157
5,014,521 A * 5/1991 Sakai ..... F25C 5/10 62/212
5,025,637 A * 6/1991 Hara ..... F25C 1/045 62/138
5,027,610 A * 7/1991 Hara ..... F25C 5/10 62/135
5,031,409 A * 7/1991 Johnson ..... F25C 5/10 62/73
5,035,118 A * 7/1991 Hara ..... F25C 1/045 62/126
5,050,398 A * 9/1991 Lane ..... F25C 5/10 62/183
5,105,632 A * 4/1992 Naruse ..... F25B 47/022 62/196.4
5,167,132 A 12/1992 Meier
RE34,210 E * 4/1993 Lane ..... F25C 1/12 62/347
5,218,830 A * 6/1993 Martineau ..... F25C 5/10 62/160
5,237,837 A * 8/1993 Naruse ..... F25C 1/12 62/303
5,239,836 A * 8/1993 Sakai ..... F25C 1/12 261/DIG. 46
5,408,834 A * 4/1995 Schlosser ..... A23G 9/228 62/303
5,586,439 A * 12/1996 Schlosser ..... A23G 9/228 62/303
5,752,393 A * 5/1998 Schlosser ..... A23G 9/228 62/303
5,794,452 A * 8/1998 Black ..... F25B 41/20 62/73
5,829,257 A * 11/1998 Newman ..... F25C 5/10 62/73
5,878,583 A * 3/1999 Schlosser ..... F25C 5/10 62/73
5,894,734 A * 4/1999 Morishita ..... F25C 5/10 62/135
6,000,228 A * 12/1999 Johnson ..... F25C 1/12 62/73
6,581,392 B1 * 6/2003 Gist ..... F25C 5/187 62/139
6,581,393 B2 * 6/2003 Newman ..... F25C 1/12 62/135
6,588,219 B2 * 7/2003 Zevlakis ..... F25C 1/04 249/119
6,637,227 B2 * 10/2003 Stensrud ..... F25C 1/00 62/217
6,668,575 B2 * 12/2003 Stensrud ..... F25B 41/22 62/298
6,681,580 B2 * 1/2004 Shedivy ..... F25C 1/12 62/73
6,691,528 B2 * 2/2004 Stensrud ..... F25C 5/10 62/344
6,711,910 B2 * 3/2004 Ziolkowski ..... F25C 5/10 62/196.4
6,725,675 B2 * 4/2004 Kampert ..... F25C 1/147 62/188
6,761,036 B2 * 7/2004 Teague ..... A23G 9/28 62/70
6,854,277 B2 * 2/2005 Gist ..... F25C 1/00 62/81
6,907,744 B2 * 6/2005 Miller ..... F25C 1/12 62/347
7,017,353 B2 * 3/2006 Gist ..... F25B 47/022 62/73
7,059,140 B2 * 6/2006 Zevlakis ..... F25C 1/04 62/340
7,062,936 B2 6/2006 Rand et al.
7,194,868 B2 * 3/2007 Yoshida ..... F25C 1/12 62/188
7,225,628 B2 * 6/2007 Furukawa ..... F25C 1/12 62/137
7,587,905 B2 * 9/2009 Kopf ..... F25D 21/08 62/137
7,681,410 B1 * 3/2010 Bean, Jr. ..... H05K 7/20818 62/259.2
7,788,934 B2 * 9/2010 Kodama ..... F25C 1/147 62/135
7,866,167 B2 * 1/2011 Kopf ..... F25C 5/187 62/66
8,978,406 B2 * 3/2015 Candeo ..... F25C 5/187 62/408

(56) References Cited

U.S. PATENT DOCUMENTS 9,644,879 B2 * 5/2017 Broadbent ..... F25C 5/185
9,733,003 B2 * 8/2017 Hoti ..... F25C 5/10
9,845,982 B2 * 12/2017 Knatt ..... F25B 49/02
10,054,352 B2 * 8/2018 Knatt ..... F25B 47/022
10,094,607 B2 * 10/2018 Broadbent ..... F25C 1/22
10,401,071 B2 * 9/2019 Knatt ..... F25C 5/182
10,775,089 B2 * 9/2020 Broadbent ..... F25C 5/20
10,801,768 B2 * 10/2020 Junge ..... F25C 1/12
10,890,368 B2 * 1/2021 Knatt ..... F25C 1/12
10,928,110 B2 * 2/2021 Broadbent ..... F25C 1/04
2001/0039804 A1 * 11/2001 Newman ..... F25C 5/10
62/66
2006/0016206 A1 * 1/2006 Gist ..... F25C 5/10
62/340
2006/0042297 A1 * 3/2006 Wakatsuki ..... F25C 5/10
62/324.1
2006/0213214 A1 * 9/2006 Choi ..... F25C 1/04
62/352
2006/0213215 A1 * 9/2006 Hirano ..... F25B 47/022
62/352
2008/0092567 A1 * 4/2008 Doberstein ..... F25C 5/187
62/137
2008/0216490 A1 * 9/2008 Wakatsuki ..... F25C 5/10
62/74
2010/0154438 A1 * 6/2010 Bean, Jr. ..... H05K 7/20818
62/3.63
2011/0185760 A1 * 8/2011 Suh ..... F25B 5/00
62/344
2012/0031115 A1 * 2/2012 Mueller ..... F25C 5/10
62/73
2014/0137593 A1 * 5/2014 Broadbent ..... F25C 5/182
62/340
2014/0182314 A1 * 7/2014 Hoti ..... F25C 5/10
62/71
2014/0208781 A1 * 7/2014 Broadbent ..... F25C 5/185
62/66
2014/0238062 A1 * 8/2014 Sul ..... F25B 47/022
62/228.2
2015/0192338 A1 * 7/2015 Knatt ..... F25C 1/00
62/66
2016/0298893 A1 * 10/2016 Knatt ..... F25C 1/12
2016/0327352 A1 * 11/2016 Broadbent ..... F25B 47/00
2016/0334157 A1 * 11/2016 Broadbent ..... F25C 5/10
2017/0003062 A1 * 1/2017 Olson, Jr ..... F25B 47/02
2017/0146280 A1 * 5/2017 Hitzelberger ..... F25C 5/24
2017/0176077 A1 * 6/2017 Knatt ..... F25C 1/12
2017/0176079 A1 * 6/2017 Bah ..... F25C 1/04
2017/0370628 A1 * 12/2017 Knatt ..... F25C 1/25
2018/0017304 A1 * 1/2018 Knatt ..... F25C 1/12
2018/0038623 A1 * 2/2018 Hoti ..... F25C 5/10
2018/0216862 A1 * 8/2018 Junge ..... F25C 1/25
2018/0252456 A1 * 9/2018 Miyakoshi ..... F25B 49/02
2018/0283760 A1 * 10/2018 Knatt ..... F25C 1/12
2019/0234664 A1 * 8/2019 Knatt ..... F25C 5/182
2019/0264933 A1 * 8/2019 Ignatiev ..... F25B 13/00
2019/0285327 A1 * 9/2019 Murgham ..... F25B 41/20
2021/0018237 A1 * 1/2021 Junge ..... F25C 1/10
2021/0071927 A1 * 3/2021 Kondou ..... F25B 13/00
2021/0080159 A1 * 3/2021 Briggs ..... F25C 1/12

FOREIGN PATENT DOCUMENTS

JP 6089974 B2 3/2017
JP 2017141985 A 8/2017
RU 2586919 C2 6/2016

* cited by examiner

ICE MAKING ASSEMBLY INCLUDING A SEALED SYSTEM FOR REGULATING THE TEMPERATURE OF THE ICE MOLD

FIELD OF THE INVENTION

The present subject matter relates generally to ice making appliances, and more particularly to sealed systems for improved harvesting in appliances for making substantially clear ice.

BACKGROUND OF THE INVENTION

In domestic and commercial applications, ice is often formed as solid cubes, such as crescent cubes or generally rectangular blocks. The shape of such cubes is often dictated by the container holder water during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water, and such liquid water can freeze within the plurality of cavities to form solid ice cubes. Typical solid cubes or blocks may be relatively small in order to accommodate a large number of uses, such as temporary cold storage and rapid cooling of liquids in a wide range of sizes.

Although the typical solid cubes or blocks may be useful in a variety of circumstances, there are certain conditions in which distinct or unique ice shapes may be desirable. As an example, it has been found that relatively large ice cubes or spheres (e.g., larger than two inches in diameter) will melt slower than typical ice sizes/shapes. Slow melting of ice may be especially desirable in certain liquors or cocktails. Moreover, such cubes or spheres may provide a unique or upscale impression for the user.

In recent years, various ice presses have come to market. For example, certain presses include metal press elements that define a profile to which a relatively large ice billet may be reshaped (e.g., in response to gravity or generated heat). Such systems reduce some of the dangers and user skill required when reshaping ice by hand. However, the time needed for the systems to melt an ice billet is generally contingent upon the size and shape of the initial ice billet. Moreover, the quality (e.g., clarity) of the final solid cube or block may be dependent on the quality of the initial ice billet.

In typical ice making appliances, such as those for forming large ice billets, impurities and gases may be trapped within the billet. For example, impurities and gases may collect near the outer regions of the ice billet due to their inability to escape and as a result of the freezing liquid to solid phase change of the ice cube surfaces. Separate from or in addition to the trapped impurities and gases, a dull or cloudy finish may form on the exterior surfaces of an ice billet (e.g., during rapid freezing of the ice cube). Generally, a cloudy or opaque ice billet is the resulting product of typical ice making appliances. In order to ensure that a shaped or final ice cube or sphere is substantially clear, many systems form solid ice billets that are substantially bigger (e.g., 50% larger in mass or volume) than a desired final ice cube or sphere. Along with being generally inefficient, this may significantly increase the amount of time and energy required to melt or shape an initial ice billet into a final cube or sphere.

In addition, freezing such a large ice billet (e.g., larger than two inches in diameter or width) may risk cracking, for instance, if a significant temperature gradient develops across the ice billet. For example, conventional ice harvesting process change the temperature of the sealed system evaporator very quickly to heat the outer surface of the large ice billet to facilitate its release. However, the use of such high temperature release processes results in temperature gradients and thermal shock which may result in cracking of the ice billet.

Accordingly, further improvements in the field of ice making would be desirable. In particular, an appliance or assembly for rapidly and reliably producing substantially clear ice billets while reducing or eliminating the risk of thermal shock and cracking of the ice billet would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice making assembly includes an ice mold defining a mold cavity, a refrigeration loop including a condenser and an evaporator in serial flow communication with each other, the evaporator being in thermal communication with the ice mold, and a compressor operably coupled to the refrigeration loop and being configured for circulating a flow of refrigerant through the refrigerant loop. A bypass conduit is fluidly coupled to the refrigeration loop at a first junction located downstream of the compressor and upstream of the condenser, the bypass conduit extending around the condenser and a flow regulating device is positioned on the refrigeration loop at the first junction and being configured for directing a portion of the flow of refrigerant through the bypass conduit.

In another exemplary aspect of the present disclosure, a sealed system for regulating a mold temperature of an ice mold of an ice making assembly includes a refrigeration loop including a condenser and an evaporator in serial flow communication with each other, the evaporator being in thermal communication with the ice mold. A compressor is operably coupled to the refrigeration loop and being configured for circulating a flow of refrigerant through the refrigerant loop. A bypass conduit extends around the condenser and a flow regulating device configured for directing a portion of the flow of refrigerant through the bypass conduit.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
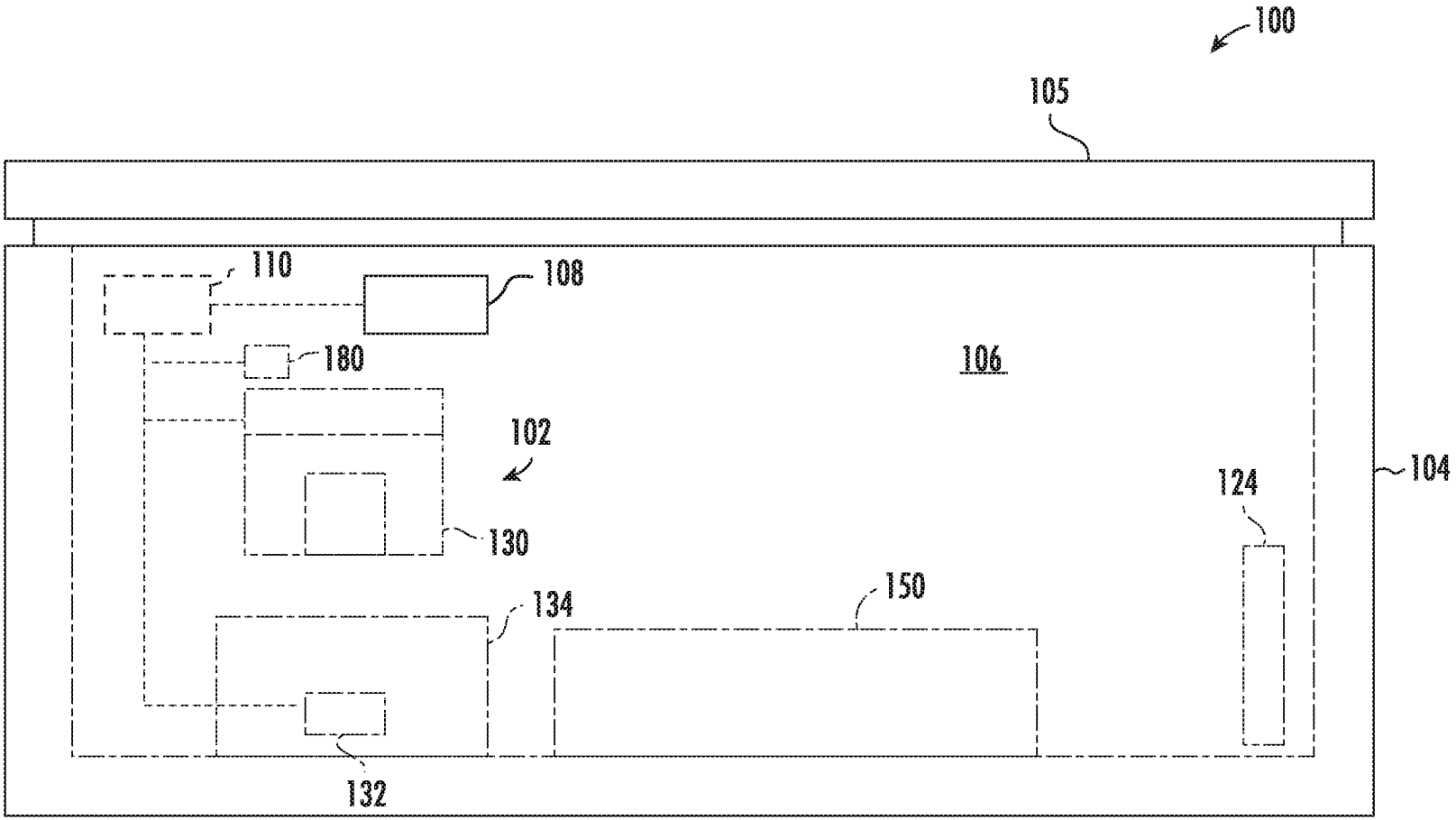
FIG. 1 provides a side plan view of an ice making appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Figure 2:
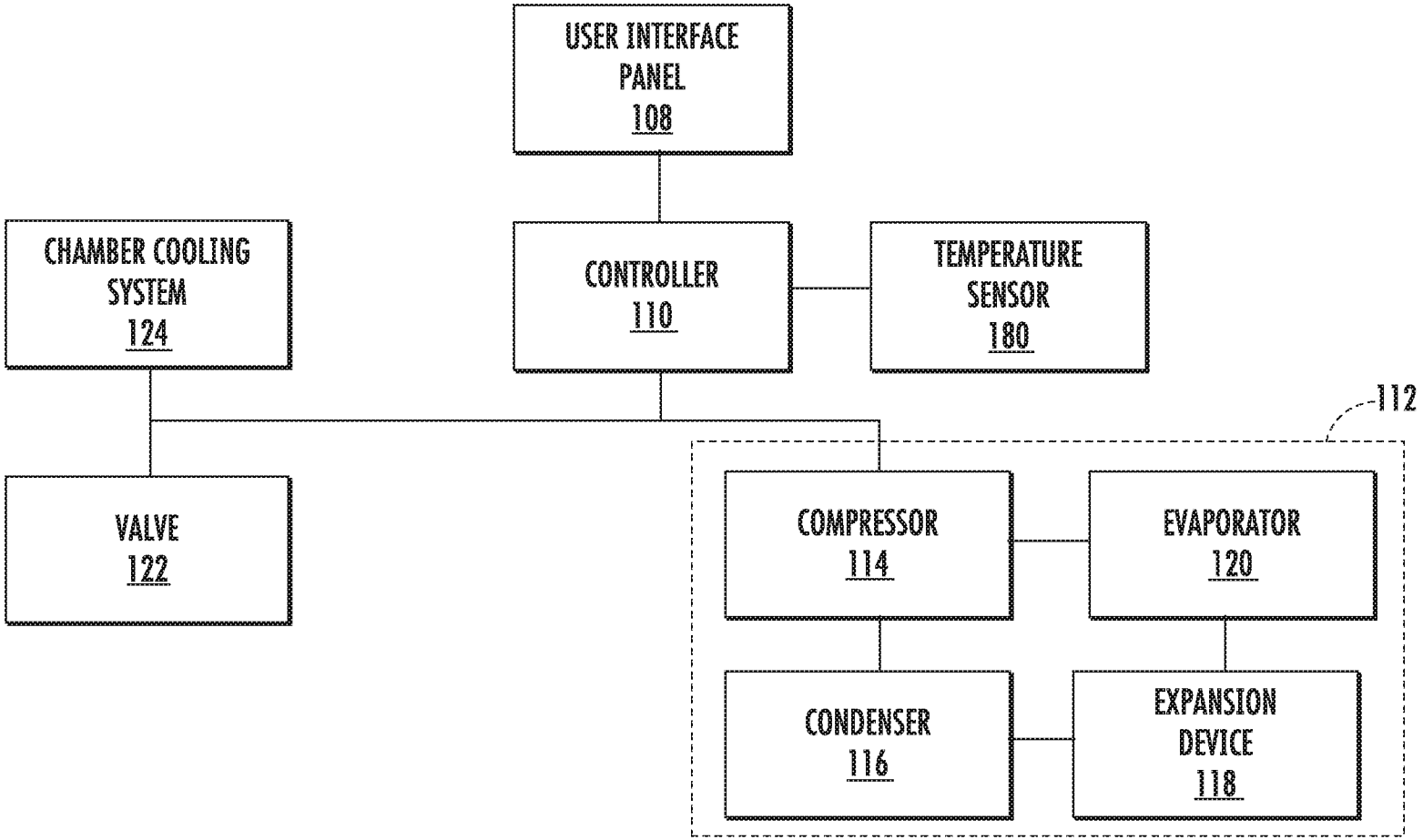
FIG. 2 provides a schematic view of an ice making assembly according to exemplary embodiments of the present disclosure.
Figure 3:
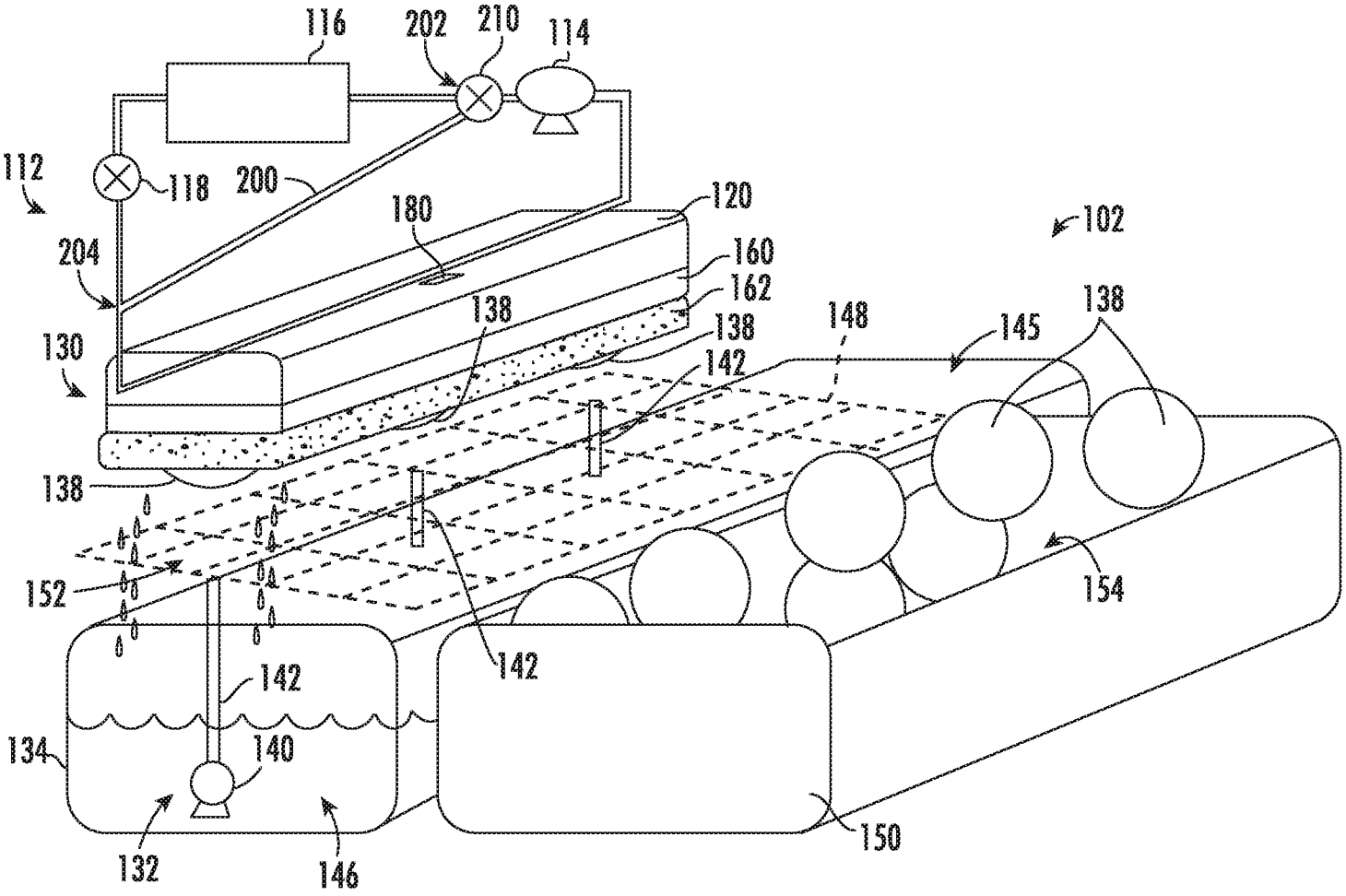
FIG. 3 provides a simplified perspective view of an ice making assembly according to exemplary embodiments of the present disclosure.

Turning now to the figures, FIG. 1 provides a side plan view of an ice making appliance 100, including an ice making assembly 102. FIG. 2 provides a schematic view of ice making assembly 102. FIG. 3 provides a simplified perspective view of ice making assembly 102. Generally, ice making appliance 100 includes a cabinet 104 (e.g., insulated housing) and defines a mutually orthogonal vertical direction V, lateral direction, and transverse direction. The lateral direction and transverse direction may be generally understood to be horizontal directions H.

As shown, cabinet 104 defines one or more chilled chambers, such as a freezer chamber 106. In certain embodiments, such as those illustrated by FIG. 1, ice making appliance 100 is understood to be formed as, or as part of, a stand-alone freezer appliance. It is recognized, however, that additional or alternative embodiments may be provided within the context of other refrigeration appliances. For instance, the benefits of the present disclosure may apply to any type or style of a refrigerator appliance that includes a freezer chamber (e.g., a top mount refrigerator appliance, a bottom mount refrigerator appliance, a side-by-side style refrigerator appliance, etc.). Consequently, the description set forth herein is for illustrative purposes only and is not intended to be limiting in any aspect to any particular chamber configuration.

Ice making appliance 100 generally includes an ice making assembly 102 on or within freezer chamber 106. In some embodiments, ice making appliance 100 includes a door 105 that is rotatably attached to cabinet 104 (e.g., at a top portion thereof). As would be understood, door 105 may selectively cover an opening defined by cabinet 104. For instance, door 105 may rotate on cabinet 104 between an open position (not pictured) permitting access to freezer chamber 106 and a closed position (FIG. 2) restricting access to freezer chamber 106.

A user interface panel 108 is provided for controlling the mode of operation. For example, user interface panel 108 may include a plurality of user inputs (not labeled), such as a touchscreen or button interface, for selecting a desired mode of operation. Operation of ice making appliance 100 can be regulated by a controller 110 that is operatively coupled to user interface panel 108 or various other components, as will be described below. User interface panel 108 provides selections for user manipulation of the operation of ice making appliance 100 such as (e.g., selections regarding chamber temperature, ice making speed, or other various options). In response to user manipulation of user interface panel 108, or one or more sensor signals, controller 110 may operate various components of the ice making appliance 100 or ice making assembly 102.

Controller 110 may include a memory (e.g., non-transitive memory) and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like; to perform control functionality instead of relying upon software).

Controller 110 may be positioned in a variety of locations throughout ice making appliance 100. In optional embodiments, controller 110 is located within the user interface panel 108. In other embodiments, the controller 110 may be positioned at any suitable location within ice making appliance 100, such as for example within cabinet 104. Input/output ("I/O") signals may be routed between controller 110 and various operational components of ice making appliance 100. For example, user interface panel 108 may be in communication with controller 110 via one or more signal lines or shared communication busses.

As illustrated, controller 110 may be in communication with the various components of ice making assembly 102 and may control operation of the various components. For example, various valves, switches, etc. may be actuatable based on commands from the controller 110. As discussed, user interface panel 108 may additionally be in communication with the controller 110. Thus, the various operations may occur based on user input or automatically through controller 110 instruction.

Figure 4:
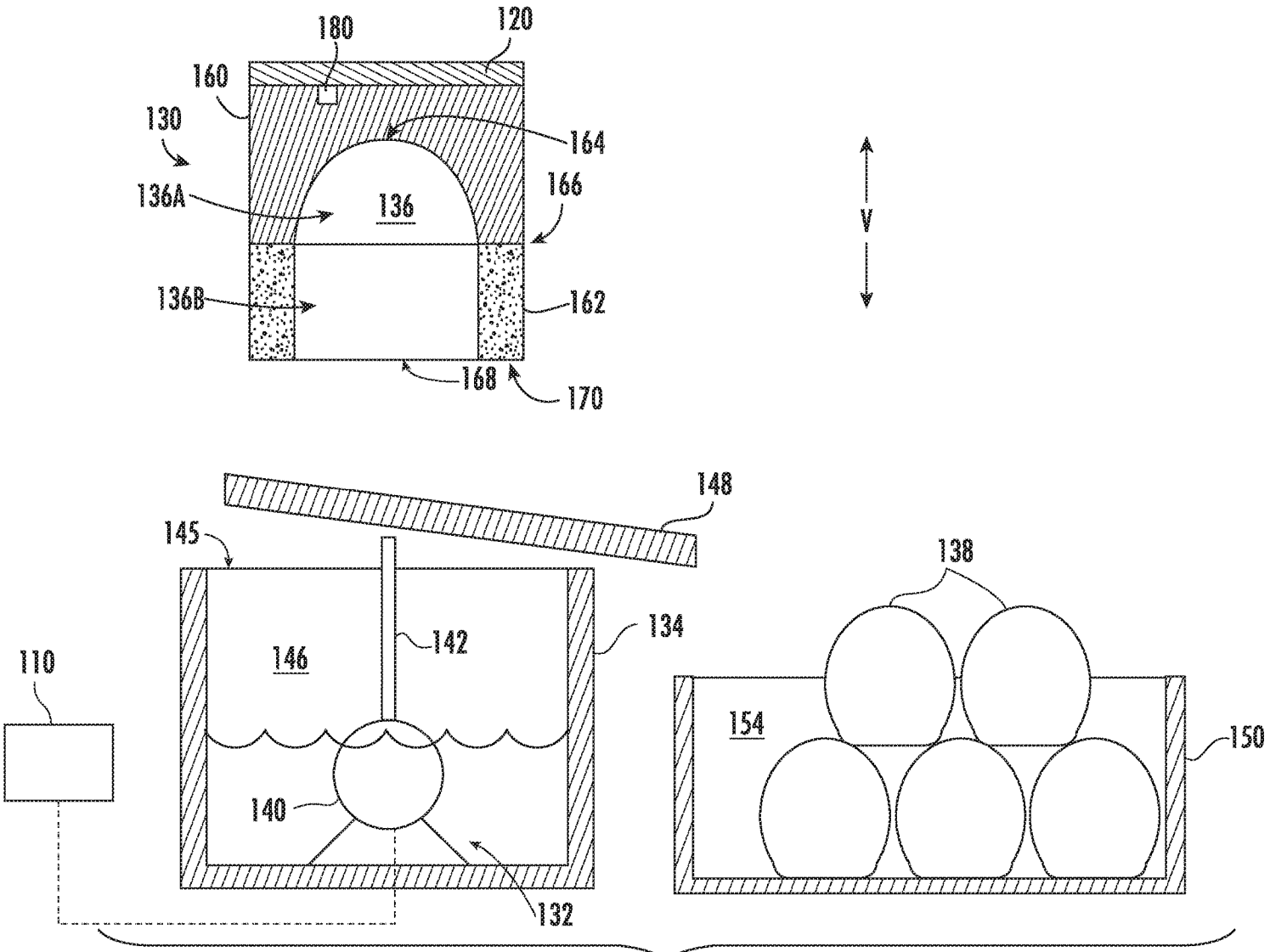
FIG. 4 provides a cross-sectional, schematic view of the exemplary ice making assembly of FIG. 3.

Generally, as shown in FIGS. 3 and 4, ice making appliance 100 includes a sealed refrigeration system 112 for executing a vapor compression cycle for cooling water within ice making appliance 100 (e.g., within freezer chamber 106). Sealed refrigeration system 112 includes a compressor 114, a condenser 116, an expansion device 118, and an evaporator 120 connected in fluid series and charged with a refrigerant. As will be understood by those skilled in the art, sealed refrigeration system 112 may include additional components (e.g., one or more directional flow valves or an additional evaporator, compressor, expansion device, or condenser). Moreover, at least one component (e.g., evaporator 120) is provided in thermal communication (e.g., conductive thermal communication) with an ice mold or mold assembly 130 (FIG. 3) to cool mold assembly 130, such as during ice making operations. Optionally, evaporator 120 is mounted within freezer chamber 106, as generally illustrated in FIG. 1.

Within sealed refrigeration system 112, gaseous refrigerant flows into compressor 114, which operates to increase the pressure of the refrigerant. This compression of the refrigerant raises its temperature, which is lowered by passing the gaseous refrigerant through condenser 116. Within condenser 116, heat exchange with ambient air takes place so as to cool the refrigerant and cause the refrigerant to condense to a liquid state.

Expansion device 118 (e.g., a mechanical valve, capillary tube, electronic expansion valve, or other restriction device) receives liquid refrigerant from condenser 116. From expansion device 118, the liquid refrigerant enters evaporator 120. Upon exiting expansion device 118 and entering evaporator 120, the liquid refrigerant drops in pressure and vaporizes. Due to the pressure drop and phase change of the refrigerant, evaporator 120 is cool relative to freezer chamber 106. As such, cooled water and ice or air is produced and refrigerates ice making appliance 100 or freezer chamber 106. Thus, evaporator 120 is a heat exchanger which transfers heat from water or air in thermal communication with evaporator 120 to refrigerant flowing through evaporator 120.

Optionally, as described in more detail below with respect to embodiments of the present subject matter, one or more directional valves may be provided (e.g., between compressor 114 and condenser 116) to selectively redirect refrigerant through a bypass line connecting the directional valve or valves to a point in the fluid circuit downstream from the expansion device 118 and upstream from the evaporator 120. In other words, the one or more directional valves may permit refrigerant to selectively bypass the condenser 116 and expansion device 120.

In additional or alternative embodiments, ice making appliance 100 further includes a valve 122 for regulating a flow of liquid water to ice making assembly 102. For example, valve 122 may be selectively adjustable between an open configuration and a closed configuration. In the open configuration, valve 122 permits a flow of liquid water to ice making assembly 102 (e.g., to a water dispenser 132 or a water basin 134 of ice making assembly 102). Conversely, in the closed configuration, valve 122 hinders the flow of liquid water to ice making assembly 102.

In certain embodiments, ice making appliance 100 also includes a discrete chamber cooling system 124 (e.g., separate from sealed refrigeration system 112) to generally draw heat from within freezer chamber 106. For example, discrete chamber cooling system 124 may include a corresponding sealed refrigeration circuit (e.g., including a unique compressor, condenser, evaporator, and expansion device) or air handler (e.g., axial fan, centrifugal fan, etc.) configured to motivate a flow of chilled air within freezer chamber 106.

Turning now to FIGS. 3 and 4, FIG. 4 provides a cross-sectional, schematic view of ice making assembly 102. As shown, ice making assembly 102 includes a mold assembly 130 that defines a mold cavity 136 within which an ice billet 138 may be formed. Optionally, a plurality of mold cavities 136 may be defined by mold assembly 130 and spaced apart from each other (e.g., perpendicular to the vertical direction V). One or more portions of sealed refrigeration system 112 may be in thermal communication with mold assembly 130. In particular, evaporator 120 may be placed on or in contact (e.g., conductive contact) with a portion of mold assembly 130. During use, evaporator 120 may selectively draw heat from mold cavity 136, as will be further described below. Moreover, a water dispenser 132 positioned below mold assembly 130 may selectively direct the flow of water into mold cavity 136. Generally, water dispenser 132 includes a water pump 140 and at least one nozzle 142 directed (e.g., vertically) toward mold cavity 136. In embodiments wherein multiple discrete mold cavities 136 are defined by mold assembly 130, water dispenser 132 may include a plurality of nozzles 142 or fluid pumps vertically aligned with the plurality mold cavities 136. For instance, each mold cavity 136 may be vertically aligned with a discrete nozzle 142.

In some embodiments, a water basin 134 is positioned below the ice mold (e.g., directly beneath mold cavity 136 along the vertical direction V). Water basin 134 includes a solid nonpermeable body and may define a vertical opening 145 and interior volume 146 in fluid communication with mold cavity 136. When assembled, fluids, such as excess water falling from mold cavity 136, may pass into interior volume 146 of water basin 134 through vertical opening 145. In certain embodiments, one or more portions of water dispenser 132 are positioned within water basin 134 (e.g., within interior volume 146). As an example, water pump 140 may be mounted within water basin 134 in fluid communication with interior volume 146. Thus, water pump 140 may selectively draw water from interior volume 146 (e.g., to be dispensed by spray nozzle 142). Nozzle 142 may extend (e.g., vertically) from water pump 140 through interior volume 146.

In optional embodiments, a guide ramp 148 is positioned between mold assembly 130 and water basin 134 along the vertical direction V. For example, guide ramp 148 may include a ramp surface that extends at a negative angle (e.g., relative to a horizontal direction) from a location beneath mold cavity 136 to another location spaced apart from water basin 134 (e.g., horizontally). In some such embodiments, guide ramp 148 extends to or terminates above an ice bin 150. Additionally or alternatively, guide ramp 148 may define a perforated portion 152 that is, for example, vertically aligned between mold cavity 136 and nozzle 142 or between mold cavity 136 and interior volume 146. One or more apertures are generally defined through guide ramp 148 at perforated portion 152. Fluids, such as water, may thus generally pass through perforated portion 152 of guide ramp 148 (e.g., along the vertical direction between mold cavity 136 and interior volume 146).

As shown, ice bin 150 generally defines a storage volume 154 and may be positioned below mold assembly 130 and mold cavity 136. Ice billets 138 formed within mold cavity 136 may be expelled from mold assembly 130 and subsequently stored within storage volume 154 of ice bin 150 (e.g., within freezer chamber 106). In some such embodiments, ice bin 150 is positioned within freezer chamber 106 and horizontally spaced apart from water basin 134, water dispenser 132, or mold assembly 130. Guide ramp 148 may span the horizontal distance between mold assembly 130 and ice bin 150. As ice billets 138 descend or fall from mold cavity 136, the ice billets 138 may thus be motivated (e.g., by gravity) toward ice bin 150.

Figure 5:
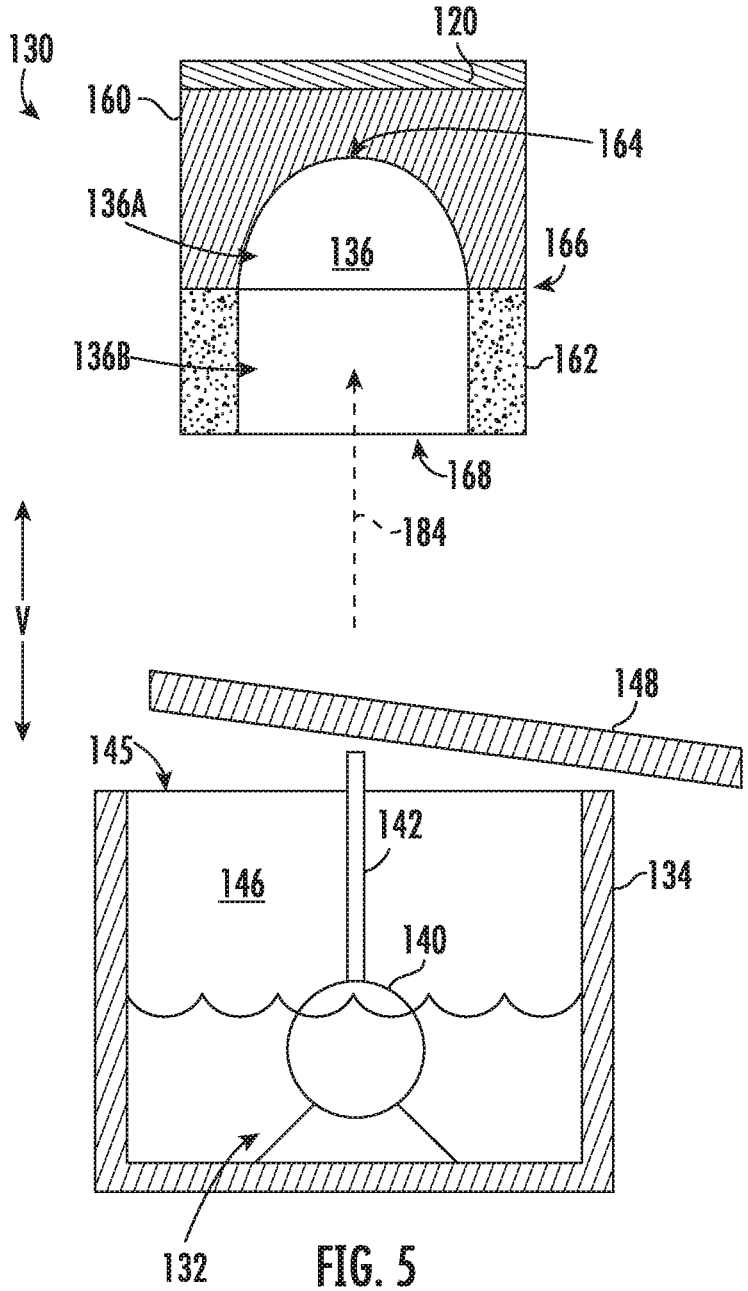
FIG. 5 provides a cross-sectional, schematic view of a portion of the exemplary ice making assembly of FIG. 3 during an ice forming operation.

Turning now generally to FIGS. 4 and 5, exemplary ice forming operations of ice making assembly 102 will be described. As shown, mold assembly 130 is formed from discrete conductive ice mold 160 and insulation jacket 162. Generally, insulation jacket 162 extends downward from (e.g., directly from) conductive ice mold 160. For instance, insulation jacket 162 may be fixed to conductive ice mold 160 through one or more suitable adhesives or attachment fasteners (e.g., bolts, latches, mated prongs-channels, etc.) positioned or formed between conductive ice mold 160 and insulation jacket 162.

Together, conductive ice mold 160 and insulation jacket 162 may define mold cavity 136. For instance, conductive ice mold 160 may define an upper portion 136A of mold cavity 136 while insulation jacket 162 defines a lower portion 136B of mold cavity 136. Upper portion 136A of mold cavity 136 may extend between a nonpermeable top end 164 and an open bottom end 166. Additionally or alternatively, upper portion 136A of mold cavity 136 may be curved (e.g., hemispherical) in open fluid communication with lower portion 136B of mold cavity 136. Lower portion 136B of mold cavity 136 may be a vertically open passage that is aligned (e.g., in the vertical direction V) with upper portion 136A of mold cavity 136. Thus, mold cavity 136 may extend along the vertical direction between a mold opening 168 at a bottom portion or bottom surface 170 of insulation jacket 162 to top end 164 within conductive ice mold 160. In some such embodiments, mold cavity 136 defines a constant diameter or horizontal width from lower portion 136B to upper portion 136A. When assembled, fluids, such as water may pass to upper portion 136A of mold cavity 136 through lower portion 136B of mold cavity 136 (e.g., after flowing through the bottom opening defined by insulation jacket 162).

Conductive ice mold 160 and insulation jacket 162 are formed, at least in part, from two different materials. Conductive ice mold 160 is generally formed from a thermally conductive material (e.g., metal, such as copper, aluminum, or stainless steel, including alloys thereof) while insulation jacket 162 is generally formed from a thermally insulating material (e.g., insulating polymer, such as a synthetic silicone configured for use within subfreezing temperatures without significant deterioration). In some embodiments, conductive ice mold 160 is formed from material having a greater amount of water surface adhesion than the material from which insulation jacket 162 is formed. Water freezing within mold cavity 136 may be prevented from extending horizontally along bottom surface 170 of insulation jacket 162.

Advantageously, an ice billet within mold cavity 136 may be prevented from mushrooming beyond the bounds of mold cavity 136. Moreover, if multiple mold cavities 136 are defined within mold assembly 130, ice making assembly 102 may advantageously prevent a connecting layer of ice from being formed along the bottom surface 170 of insulation jacket 162 between the separate mold cavities 136 (and ice billets therein). Further advantageously, the present embodiments may ensure an even heat distribution across an ice billet within mold cavity 136. Cracking of the ice billet or formation of a concave dimple at the bottom of the ice billet may thus be prevented.

In some embodiments, the unique materials of conductive ice mold 160 and insulation jacket 162 each extend to the surfaces defining upper portion 136A and lower portion 136B of mold cavity 136. In particular, a material having a relatively high water adhesion may define the bounds of upper portion 136A of mold cavity 136 while a material having a relatively low water adhesion defines the bounds of lower portion 136B of mold cavity 136. For instance, the surface of insulation jacket 162 defining the bounds of lower portion 136B of mold cavity 136 may be formed from an insulating polymer (e.g., silicone). The surface of conductive mold cavity 136 defining the bounds of upper portion 136A of mold cavity 136 may be formed from a thermally conductive metal (e.g., aluminum or copper). In some such embodiments, the thermally conductive metal of conductive ice mold 160 may extend along (e.g., the entirety of) of upper portion 136A.

Although an exemplary mold assembly 130 is described above, it should be appreciated that variations and modifications may be made to mold assembly 130 while remaining within the scope of the present subject matter. For example, the size, number, position, and geometry of mold cavities 136 may vary. In addition, according to alternative embodiments, an insulation film may extend along and define the bounds of upper portion 136A of mold cavity 136, e.g., may extend along an inner surface of conductive ice mold 160 at upper portion 136A of mold cavity 136. Indeed, aspects of the present subject matter may be modified and implemented in a different ice making apparatus or process while remaining within the scope of the present subject matter.

In some embodiments, one or more sensors are mounted on or within ice mold 160. As an example, a temperature sensor 180 may be mounted adjacent to ice mold 160. Temperature sensor 180 may be electrically coupled to controller 110 and configured to detect the temperature within ice mold 160. Temperature sensor 180 may be formed as any suitable temperature detecting device, such as a thermocouple, thermistor, etc. Although temperature sensor 180 is illustrated as being mounted to ice mold 160, it should be appreciated that according to alternative embodiments, temperature sensor may be positioned at any other suitable location for providing data indicative of the temperature of the ice mold 160. For example, temperature sensor 180 may alternatively be mounted to a coil of evaporator 120 or at any other suitable location within ice making appliance 100.

As shown, controller 110 may be in communication (e.g., electrical communication) with one or more portions of ice making assembly 102. In some embodiments, controller 110 is in communication with one or more fluid pumps (e.g., water pump 140), compressor 114, flow regulating valves, etc. Controller 110 may be configured to initiate discrete ice making operations and ice release operations. For instance, controller 110 may alternate the fluid source spray to mold cavity 136 and a release or ice harvest process, which will be described in more detail below.

During ice making operations, controller 110 may initiate or direct water dispenser 132 to motivate an ice-building spray (e.g., as indicated at arrows 184) through nozzle 142 and into mold cavity 136 (e.g., through mold opening 168). Controller 110 may further direct sealed refrigeration system 112 (e.g., at compressor 114) (FIG. 3) to motivate refrigerant through evaporator 120 and draw heat from within mold cavity 136. As the water from the ice-building spray 184 strikes mold assembly 130 within mold cavity 136, a portion of the water may freeze in progressive layers from top end 164 to bottom end 166. Excess water (e.g., water within mold cavity 136 that does not freeze upon contact with mold assembly 130 or the frozen volume herein) and impurities within the ice-building spray 184 may fall from mold cavity 136 and, for example, to water basin 134.

Once ice billets 138 are formed within mold cavity 136, in ice release or harvest process may be performed in accordance with embodiments of the present subject matter. Specifically, sealed system 112 may further include a bypass conduit 200 that is fluidly coupled to refrigeration loop or sealed system 112 for routing a portion of the flow of refrigerant around condenser 116. In this manner, by selectively regulating the amount of relatively hot refrigerant flow that exits compressor 114 and bypasses condenser 116, the temperature of the flow of refrigerant passing into evaporator 120 may be precisely regulated.

Specifically, according to the illustrated embodiment, bypass conduit 200 extends from a first junction 202 to a second junction 204 within sealed system 112. First junction 202 is located between compressor 114 and condenser 116, e.g., downstream of compressor 114 and upstream of condenser 116. By contrast, second junction 204 is located between condenser 116 and evaporator 120, e.g., downstream of condenser 116 and upstream of evaporator 120. Moreover, according to the illustrated embodiment, second junction 204 is also located downstream of expansion device 118, although second junction 204 could alternatively be positioned upstream of expansion device 118. When plumbed in this manner, bypass conduit 200 provides a pathway through which a portion of the flow of refrigerant may pass directly from compressor 114 to a location immediately upstream of evaporator 120 to increase the temperature of evaporator 120.

Notably, if substantially all of the flow of refrigerant were diverted from compressor 114 through bypass conduit 200 when ice mold 160 is still very cold (e.g., below 10° F. or 20° F.), the thermal shock experienced by ice billets 138 due to the sudden increase in evaporator temperature might cause ice billets 138 to crack. Therefore, aspects of the present subject matter are directed to features and methods for slowly regulating or precisely controlling the evaporator temperature to achieve the desired mold temperature profile and harvest release time to prevent the ice billets 138 from cracking.

In this regard, for example, bypass conduit 200 may be fluidly coupled to sealed system 112 using a flow regulating device 210. Specifically, flow regulating device 210 may be used to couple bypass conduit 200 to sealed system 112 at first junction 202. In general, flow regulating device 210 may be any device suitable for regulating a flow rate of refrigerant through bypass conduit 200. For example, according to an exemplary embodiment of the present subject matter, flow regulating device 210 is an electronic expansion device which may selectively divert a portion of the flow of refrigerant exiting compressor 114 into bypass conduit 200. According to still another embodiment, flow regulating device 210 may be a servomotor-controlled valve for regulating the flow of refrigerant through bypass conduit 200. According to still other embodiments, flow regulating device 210 may be a three-way valve mounted at first junction 202 or a solenoid-controlled valve operably coupled along bypass conduit 200.

According to exemplary embodiments of the present subject matter, controller 110 may initiate an ice release or harvest process to discharge ice billets 138 from mold cavities 136. Specifically, for example, controller 110 may first halt or prevent the ice-building spray 184 by de-energizing water pump 140. Next, controller 110 may regulate the operation of sealed system 112 to slowly increase a temperature of evaporator 120 and ice mold 160. Specifically, by increasing the temperature of evaporator 120, the mold temperature of ice mold 160 is also increased, thereby facilitating partial melting or release of ice billets 138 from mold cavities.

According to exemplary embodiments, controller 110 may be operably coupled to flow regulating device 210 for regulating a flow rate of the flow of refrigerant through bypass conduit 200. Specifically, according to an exemplary embodiment, controller 110 may be configured for obtaining a mold temperature of the mold body using temperature sensor 180. Although the term "mold temperature" is used herein, it should be appreciated that temperature sensor 180 may measure any suitable temperature within the ice making appliance 100 that is indicative of mold temperature and may be used to facilitate improved harvest of ice billets 138.

Controller 110 may further regulate the flow regulating device 210 to control the flow of refrigerant based in part on the measured mold temperature. For example, according to an exemplary embodiment, flow regulating device 210 may be regulated such that a rate of change of the mold temperature does not exceed a predetermined threshold rate. For example, this predetermined threshold rate may be any suitable rate of temperature change beyond which thermal cracking of ice billets 138 may occur. For example, according to an exemplary embodiment, the predetermined threshold rate may be approximately 1° F. per minute, about 2° F. per minute, about 3° F. per minute, or higher. According to exemplary embodiments, the predetermined threshold rate may be less than 10° F. per minute, less than 5° F. permanent, less than 2° F. per minute, or lower. In this manner, flow regulating device 210 may regulate the rate of temperature change of ice billets 138, thereby preventing thermal cracking.

Notably, once the temperature of ice billets 138 has reached a suitable temperature threshold, it may be safe to direct the entire flow of refrigerant around condenser 116 without cracking ice billets 138. Thus, according to an exemplary embodiment, controller 110 may be configured for detecting when the mold temperature has exceeded a predetermined temperature threshold (e.g., a threshold at which the risk of thermal cracking of ice billets 138 is reduced or almost entirely eliminated). When such temperature is achieved, controller 110 may be configured for further regulating flow regulating device 210 to direct substantially all of the flow of refrigerant through bypass conduit 200 and directly into evaporator 120, e.g., to achieve the quick heating of evaporator 120 and the almost immediate release of ice billets 138.

In general, the sealed system 112 and methods of operation described herein are intended to regulate a temperature change of ice billets 138 to prevent thermal cracking. However, although specific control algorithms and system configurations are described, it should be appreciated that according to alternative embodiments variations and modifications may be made to such systems and methods while remaining within the scope of the present subject matter. For example, the exact plumbing of bypass conduit 200 may vary, the type or position of flow regulating device 210 may change, and different control methods may be used while remaining within scope of the present subject matter. In addition, depending on the size and shape of ice billets 138, the predetermined threshold rate and predetermined temperature threshold may be adjusted to prevent that particular set of ice billets 138 from cracking, or to otherwise facilitate an improved harvest procedure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

an ice mold defining a mold cavity;

a refrigeration loop comprising a condenser and an evaporator in serial flow communication with each other, the evaporator being in thermal communication with the ice mold;

a temperature sensor in thermal communication with the ice mold;

a compressor operably coupled to the refrigeration loop and being configured for circulating a flow of refrigerant through the refrigerant loop;

a bypass conduit fluidly coupled to the refrigeration loop at a first junction located downstream of the compressor and upstream of the condenser, the bypass conduit extending around the condenser;

a flow regulating device positioned on the refrigeration loop at the first junction and being configured for directing a portion of the flow of refrigerant through the bypass conduit; and a controller operably coupled to the flow regulating device and the temperature sensor, the controller being configured for:

obtaining a mold temperature of the ice mold using the temperature sensor; and regulating the flow regulating device to control the flow of refrigerant based on the mold temperature.

2. The ice making assembly of claim 1, wherein the bypass conduit extends from the first junction to a second junction located downstream of the condenser and upstream of the evaporator.

3. The ice making assembly of claim 2, further comprising:

a first expansion device fluidly coupled to the refrigeration loop between the condenser and the evaporator, wherein the second junction is located downstream of the first expansion device and upstream of the evaporator.

4. The ice making assembly of claim 1, wherein the flow regulating device is an electronic expansion device.

5. The ice making assembly of claim 1, wherein the flow regulating device comprises a servomotor-controlled valve for regulating the flow of refrigerant through the bypass conduit.

6. The ice making assembly of claim 1, wherein the controller is further configured for:

alternately initiating an ice-building spray into the mold cavity to form ice and a harvest process to remove the formed ice.

7. The ice making assembly of claim 1, wherein regulating the flow regulating device further comprises regulating the flow regulating device such that a rate of change of the mold temperature does not exceed a predetermined threshold rate of the mold temperature.

8. The ice making assembly of claim 7, wherein the predetermined threshold rate is three degrees Fahrenheit per minute.

9. The ice making assembly of claim 7, wherein the controller is further configured for:

determining that the mold temperature has exceeded a predetermined temperature threshold; and fully opening the flow regulating device to pass substantially all of the flow of refrigerant through the bypass conduit in response to determining that the mold temperature has exceeded the predetermined temperature threshold.

10. The ice making assembly of claim 1, further comprising:

a water dispenser positioned below the ice mold to direct an ice-building spray of water upward into the mold cavity.

11. The ice making assembly of claim 10, further comprising:

a water basin positioned below the ice mold to receive excess water from the ice-building spray.

12. The ice making assembly of claim 1, further comprising:

an ice bin positioned below the ice mold to receive ice therefrom.

13. A sealed system for regulating a mold temperature of an ice mold of an ice making assembly, the sealed system comprising:

a refrigeration loop comprising a condenser and an evaporator in serial flow communication with each other, the evaporator being in thermal communication with the ice mold;

a compressor operably coupled to the refrigeration loop and being configured for circulating a flow of refrigerant through the refrigerant loop;

a bypass conduit extending around the condenser;

a flow regulating device configured for directing a portion of the flow of refrigerant through the bypass conduit;

a temperature sensor in thermal communication with the ice mold; and a controller operably coupled to the flow regulating device and the temperature sensor for obtaining a mold temperature using the temperature sensor and regulating a flow rate of the flow of refrigerant through the bypass conduit based at least in part on the mold temperature.

14. The sealed system of claim 13, wherein the bypass conduit extends from a first junction located downstream of the compressor and upstream of the condenser to a second junction located downstream of the condenser and upstream of the evaporator.

15. The sealed system of claim 14, further comprising:

a first expansion device fluidly coupled to the refrigeration loop between the condenser and the evaporator, wherein the second junction is located downstream of the first expansion device and upstream of the evaporator.

16. The sealed system of claim 13, wherein the flow regulating device is an electronic expansion device.

17. The sealed system of claim 13, wherein the flow regulating device comprises a servomotor-controlled valve for regulating the flow of refrigerant through the bypass conduit.

18. The sealed system of claim 13, wherein the controller is further configured for:

obtaining the mold temperature of the ice mold using the temperature sensor;

regulating the flow regulating device to control the flow of refrigerant such that a rate of change of the mold temperature does not exceed a predetermined threshold rate; and fully opening the flow regulating device to pass substantially all of the flow of refrigerant through the bypass conduit in response to determining that the mold temperature has exceeded a predetermined temperature threshold.

* * * * *